United States Patent [19]

Bubelo et al.

[11] Patent Number: 4,464,845

[45] Date of Patent: Aug. 14, 1984

[54] METHOD OF HEAT- AND MOISTURE TREATMENT OF ARTICLES, FOR EXAMPLE, CONCRETE ARTICLES, AND AN APPARATUS FOR ACCOMPLISHING SAME

[76] Inventors: Vilya V. Bubelo, ulitsa Avdeeva, 4, kv. 110; Vitaly M. Timofeev, ulitsa Avdeeva, 67, kv. 4; Vladimir I. Ganzhara, ulitsa Avdeeva, 4, kv. 77, all of Tselinograd; Raisa M. Froze, Chelyabinskaya ulitsa, 27, kv. 128, Moscow, all of U.S.S.R.

[21] Appl. No.: 417,402

[22] Filed: Sep. 13, 1982

Related U.S. Application Data

[62] Division of Ser. No. 198,923, Oct. 20, 1980, Pat. No. 4,362,505.

[51] Int. Cl.[3] ..... F26B 7/00; F26B 9/12; F27B 9/04

[52] U.S. Cl. ..... 34/18; 432/18; 432/23

[58] Field of Search ..... 432/18, 23; 264/345, 264/346; 34/28

[56] References Cited

U.S. PATENT DOCUMENTS

| | | | |
|---|---|---|---|
| 584,645 | 6/1897 | Olsen | 432/128 |
| 1,171,874 | 2/1916 | Petersen | 432/128 |
| 1,793,086 | 2/1931 | Hartford | 34/28 |
| 3,471,135 | 10/1969 | Cremer | 432/128 |
| 3,841,641 | 10/1974 | Ukuno | 432/64 |
| 4,192,645 | 3/1980 | Hassler | 432/144 |
| 4,249,895 | 2/1981 | Mantegani | 432/128 |
| 4,310,300 | 1/1982 | Mackenzie | 432/128 |

FOREIGN PATENT DOCUMENTS

| | | | |
|---|---|---|---|
| 643476 | 1/1979 | U.S.S.R. | 264/345 |
| 684027 | 6/1979 | U.S.S.R. | 264/345 |

*Primary Examiner*—John J. Camby

*Attorney, Agent, or Firm*—Robert E. Burns; Emmanuel J. Lobato; Bruce L. Adams

[57] ABSTRACT

The characteristic feature of the herein disclosed method resides in that it involves a zone control over temperature and humidity of articles being treated within the space of a tunnel chamber, the articles being blown with an air agent having a temperature of 40°–100° C. prior to the step of temperature increase whereas in the zone of said temperature increase the articles are treated with a steam-air mixture for a period of 1–6 hours, the temperatures and humidity of the mixture being gradually increased to their permissible values corresponding to the given type of articles being treated; in so doing the articles in the isothermal curing zone are affected for a period of 2–6 hours with a heat-carrying agent having a temperature of 60°–95° C. and a relative humidity close to 100% while in the cooling zone the articles are blown with a cooling agent having a relative humidity of 35–90% for a period of 0.3–1.5 hours. The characteristic feature of the apparatus for realizing the method of this invention consists in that the apparatus includes a chamber for pre-drying of articles, said chamber being provided with air ducts and communicated by means of one of the latter air ducts with an air screen manifold located at the inlet to the tunnel chamber.

1 Claim, 1 Drawing Figure

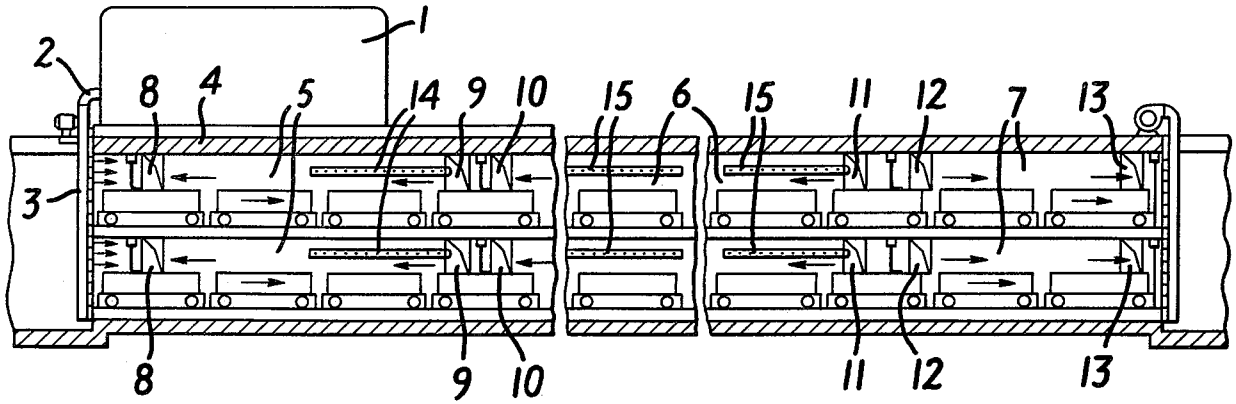
1
2
3
4
5
6
7
8
8
9
9
10
10
11
11
12
12
13
13
14
15
15

METHOD OF HEAT- AND MOISTURE TREATMENT OF ARTICLES, FOR EXAMPLE, CONCRETE ARTICLES, AND AN APPARATUS FOR ACCOMPLISHING SAME

This is a divisional of application Ser. No. 198,923, filed Oct. 20, 1980, now U.S. Pat. No. 4,362,505.

BACKGROUND OF THE INVENTION

The present invention relates to the manufacture of building materials and, more particularly, it relates to a method of heat-and-moisture treatment of articles such as concrete articles and to an apparatus for accomplishing same.

This invention can be used in the industry of building materials, in civil, rural and industrial construction for manufacturing articles from heavy, cellular and light concrete, silicate, foamed concrete and gypsum, as well as other building materials which need to be heat-and-moisture treated after molding.

There are presently known various methods of heat-and-moisture treatment of concrete, reinforced concrete and other articles, including those involving zone and sectional temperature control; in particular, in a circular tunnel chamber when specific thermal conditions are maintained in each one of the sections (zones), with the articles being subjected at one of the steps to the effect of superheated steam and carbon dioxide gas and, at the next step, to the effect of steam, after which the articles are treated with air and then cooled.

However, the prior art methods and apparatus for accomplishing same provide for heat treatment without controlling the relative humidity of the medium at all steps of heat treatment. While so doing, at the initial steps, upon the effect of superheated steam and then of steam with carbon dioxide gas, the continuity of the structure is disturbed considerably which leads to reduced strength. In addition, the use of the latter is rather expensive due to high capital costs.

There is also known a method for hardening and drying articles of light concrete, wherein the hardening of steam-treated articles is accelerated by using part of the moisture extracted from the articles in the course of drying them with hot air.

The latter method can only be used for drying light concrete articles and is absolutely inapplicable in the case of other types of concrete such as heavy concrete in view of dehydration and deterioration of all principal physical-and-mechanical characteristics of the latter.

There are other known methods of heat-and-moisture treatment of concrete articles, in particular, in a tunnel chamber with the aid of electric heaters attached to the inner walls of the chamber and serving to accelerate, by means of infrared radiation, the heat transfer to concrete, mainly ensuring the drying of the articles. The latter prior art method suffers from considerable non-uniformity of heat-treatment conditions over the chamber zones and stages while the thermodynamic parameters of the medium (temperature, humidity, velocity) sometimes fail to satisfy the conditions of heat-and-moisture treatment. This leads to deterioration of physical and mechanical parameters of articles and results in that this method is mainly suitable for use in the manufacture of light concrete articles, which restricts considerably the sphere of its application.

Also known in the art are methods of steam-heat treatment, which involve the provision in the chamber zones of autonomous heating and recirculation systems involving the use of aerodynamic-effect power units with additional heaters, with a possibility of supplying steam to the working space.

This and similar prior art methods suffer from difficulties in the discharge of the steam-gas phase from concrete and in the control over the relative humidity of the medium and over mass transfer, also leading to degradation. This results in a lower quality of the articles due to discontinuation of the growth of the strength of the concrete as well as to reduced resistance to cold, durability and other qualitative factors. The latter method is only suitable for use with articles featuring a low modulus of exposed surface.

In view of the afore-listed disadvantages inherent in most of the above-cited prior art methods, further intensification of the process of heat-and-moisture treatment of articles becomes difficult and, in the case of some articles, simply impossible.

SUMMARY OF THE INVENTION

It is the principal object of the present invention to reduce the time required for heat-and-moisture treatment of articles, as well as to improve the quality owing to reducing the degradation of concrete and increasing its strength, cold resistance and homogeneity in articles.

It is another object of this invention to reduce the cycle of heat treatment of articles by way of speeding up hydration hardening at all stages.

These and other objects are attained with the aid of a method of heat-and-moisture treatment of articles such as concrete articles, involving a zone control over temperature and humidity within the space of a tunnel chamber by way of temperature increase, isothermal curing of articles and cooling of the latter, wherein, according to the invention, prior to the step of temperature increase, the articles are blown with an air agent having a temperature of from about 40° to about 100° C. whereas in the zone of temperature increase the articles are affected with a steam-air mixture for a period of from 1 to 6 hours, the temperature and humidity of the mixture being increased gradually up to their permissible values corresponding to the given types of articles being treated while the articles in the zone of isothermal curing are treated for a period of from 2 to 6 hours with a heat-carrying agent having a temperature of from about 60° to about 95° C. and a relative humidity close to 100% and in the cooling zone the articles are blown with a cooling agent having a relative humidity of from about 35 to about 90% for a period of from 0.3 to 1.5 hours.

The object set is also attained with the aid of an apparatus designed for accomplishing the method of the invention, including a tunnel chamber with zones of temperature increase, isothermal curing of articles and cooling of the latter, the tunnel chamber having an air screen manifold located at the inlet thereof, in which apparatus, according to the present invention, provision is made of a predrying chamber having air ducts and communicating by means of one of the latter with the air screen manifold.

It is expedient that the apparatus of the invention be provided with recirculation loops over all of the tunnel chamber zones, with a possibility of discharging part of the recirculate from the last one of said loops.

The herein disclosed method of heat-and-moisture treatment of articles resides essentially in ensuring an intensive and continuous flow of all of the basic hydration reactions while obviating the harmful effect of heat- and mass transfer processes, by way of zone control over the thermodynamic parameters of the medium (temperature and humidity), including the zones of temperature increase, isothermal curing and cooling of molded articles.

In so doing, the method is carried out such that an article, prior to the step of temperature increase, should be blown with an air agent having a temperature of from 40° to 100° C.; in the zone of temperature increase, the article is affected with a steam-air mixture for a period of from 1 to 6 hours, with the temperature of the mixture increasing (from 60° to 95°) and maintained over the step of isothermal curing of articles; as to the relative humidity of the medium, it increases gradually over the step of temperature increase and, over the step of isothermal curing, maintains its value close to 100% for a period of from 2 to 6 hours.

While so doing, the articles in the cooling zone are blown with a cooling agent having a relative humidity of from about 35 to about 90% for a period of from about 0.3 to 1.5 h.

BRIEF DESCRIPTION OF THE DRAWING

Following is a detailed description of a specific embodiment of the method according to the invention utilizing the herein disclosed apparatus for accomplishing same, with due reference to the accompanying drawing wherein:

The sole FIGURE is a longitudinal sectional view of the apparatus according to the invention.

DESCRIPTION OF THE PREFERRED EMBODIMENT

The apparatus for accomplishing the method of the invention is a continuous-action thermal unit including a pre-drying chamber 1. The end of the chamber 1 communicates by means of air ducts 2, with a manifold 3 of an air screen of a tunnel chamber 4 having a zone 5 of temperature increase, a zone 6 of isothermal curing of articles and a zone 7 of cooling molded articles.

Each one of the zones is provided with preheat and recirculation loops with inlet and outlet pipes, respectively, pipes 8 and 9 for the zone of temperature increase, pipes 10 and 11 for the isothermal curing zone 6, and pipes 12 and 13 for the cooling zone 7. For moistening the medium in the zones of temperature increase and isothermal curing provision is made for the supply of steam via conduits 14 and 15.

Thus, the article is first directed to the pre-drying chamber 1 to which an air agent is supplied for treating the article surface therewith. Then, the spent air agent is transferred to the air screen manifold 3 of the tunnel chamber 4 to which the articles are delivered after the pre-drying chamber 1.

In the chamber 4, the articles pass successively the zones of temperature increase, isothermal curing and cooling of articles, where they are treated with a steam-air medium and steam featuring thermodynamic parameters corresponding to the stage of the heat treatment. After being treated as described above, the articles are moved outside of the tunnel chamber 4.

The present invention will be more apparent upon considering the following examples illustrating the method embodying the invention.

EXAMPLE 1

A Grade 200 concrete mix featuring a water-cement ratio of 0.35 and frustum shrinkage of 3–5 cm was used to mold a 1.5×6 m plate; simultaneously, check sample cubes were molded for heat-and-moisture treatment according to the disclosed method, for purely steam treatment according to a prior art method, as well as samples for natural hardening. The cubes together with the articles were subjected to heat-and-moisture treatment by moving them successively from the pre-drying chamber to the zones of temperature increase, isothermal curing and cooling wherein the articles and cubes had been affected with a steam-air medium featuring parameters such as those recited in the specification. The test results presented in Table 1 are indicative of considerably improved characteristics as compared with prior art methods involving purely steam treatment of concrete, namely, increased strength and cold resistance, early hardening.

EXAMPLE 2

A Grade 200 concrete mix featuring a frustum shrinkage of 0 cm and water-cement ratio of 0.4 was used to mold a 1.5×6 m plate. Simultaneously, check sample cubes were molded for heat treatment according to the method of the invention, according to a prior art method involving treatment in a steam medium, and for natural hardening.

The test results are presented in Table 1.

EXAMPLE 3

A Grade 300 concrete mix featuring a stiffness of 30 seconds and water-cement ratio of 0.38 was used to mold a 3×6 m panel. Simultaneously, check sample cubes were molded for heat treatment according to the method of the invention, according to a prior art method involving purely steam heating, and for natural hardening. A comparison of the experimental data has shown all of the basic qualitative characteristics according to the disclosed method to exceed analogous characteristics in the case of purely steam treatment of concrete and to approach those in the case of natural hardening of concrete (Table 1).

TABLE 1

| 1 | 2 | Average strength, MPa 3 | Early hardening index 4 | Water absorption, % 5 | Cold resistance factor, 50 cycles 6 | Cold resistance factor, 100 cycles 7 |
|---|---|---|---|---|---|---|
| Ex. 1 | Disclosed method | 14.2/23.0 | 1.0 | | | |
| | Purely steam treatment | 11.2/23.5 | 0.67 | | | |
| Ex. 2 | Disclosed method | 13.5/24.5 | 0.96 | | | |
| | Purely steam treatment | 13.0/24.0 | 0.76 | | | |
| Ex. 3 | Disclosed method | 23.2/31.3 | 0.98 | | | |
| | Purely steam treatment | 21.5/32.4 | 0.78 | | | |

TABLE 1-continued

| | | |
|---|---|---|
| 3.87/4.17 | 0.95/0.97 | 0.82/0.90 |
| 5.29/4.08 | 0.86/0.95 | 0.72/0.91 |
| 4.18/4.04 | 0.92/0.91 | 0.88/0.89 |
| 5.6/4.35 | 0.89/0.94 | 0.78/0.91 |
| 3.92/3.85 | 0.94/0.96 | 0.89/0.91 |
| 4.52/5.04 | 0.85/0.98 | 0.80/0.92 |

Note: Denominator gives the results of testing naturally hardened check sample cubes.

The foregoing data indicate that articles prepared with the aid of the method of the invention feature qualitative characteristics exceeding those yielded by purely steam methods of heat treatment, namely:

the strength increases by 10–20% and approaches that of naturally hardened concretes;

cold resistance increases, as well as the homogeneity of articles with respect to strength;

the duration of heat-and-moisture treatment of articles is reduced by 30–40%.

The reduction of the duration of heat treatment, as well as more efficient utilization of thermal energy supplied to the articles, results in a considerably lower steam consumption and, consequently, overall energy consumption.

Owing to the ease of manufacture and use, the method and apparatus of the invention can be used both under stationary and field conditions at moderate capital costs in acting enerprises and in those under construction.

The present invention helps produce diverse articles based on concrete of the various grades and types.

What is claimed is:

1. A method of heat-and-moisture treatment of concrete articles comprising, pre-drying concrete articles by blowing of air thereon at a temperature of 70° C. to 100° C., isothermally treating the pre-dried concrete articles with a steam-air mixture for a period of 1–6 hours at a temperature and humidity gradually increased up to the permissible values corresponding to the given type of concrete articles being treated, subsequently immediately treating the concrete articles for a period of 2 to 6 hours with an air-steam mixture at a temperature of 65° to 95° C. and a relative humidity close to 100%, and then immediately cooling the concrete articles by blowing thereon slightly heated cooling air for a period of 0.3 to 1.5 hours and at a relative humidity of 35–95%.

* * * * *